US008186957B2

(12) United States Patent
Moreau et al.

(10) Patent No.: US 8,186,957 B2
(45) Date of Patent: May 29, 2012

(54) FAN PROPELLER, IN PARTICULAR FOR MOTOR VEHICLES

(75) Inventors: Stéphane Moreau, Paris (FR); Antoine Levasseur, Montigny-le-Bretonneus (FR); Aurélien Levasseur, Elancourt (FR); Manuel Henner, Auffargis (FR); Bruno Demory, Vaureal (FR); Cédric Lebert, Puteaux (FR)

(73) Assignee: Valeo Systemes Thermiques, Le Mesnil-Saint-Denis, Cedex (FR)

( * ) Notice: Subject to any disclaimer, the term of this patent is extended or adjusted under 35 U.S.C. 154(b) by 728 days.

(21) Appl. No.: 12/293,933

(22) PCT Filed: Mar. 14, 2007

(86) PCT No.: PCT/EP2007/052401

§ 371 (c)(1),
(2), (4) Date: Mar. 23, 2009

(87) PCT Pub. No.: WO2007/107489

PCT Pub. Date: Sep. 27, 2007

(65) Prior Publication Data

US 2009/0311101 A1 Dec. 17, 2009

(30) Foreign Application Priority Data

Mar. 23, 2006 (FR) ..... 06 02510

(51) Int. Cl.

| | |
|---|---|
| ***A47C 7/74*** | (2006.01) |
| ***A47C 21/04*** | (2006.01) |
| ***B63H 1/00*** | (2006.01) |
| ***B63H 3/00*** | (2006.01) |
| ***B63H 5/00*** | (2006.01) |
| ***B63H 7/00*** | (2006.01) |
| ***B63H 13/00*** | (2006.01) |
| ***B63H 15/00*** | (2006.01) |
| ***B64C 11/00*** | (2006.01) |
| ***B64C 27/00*** | (2006.01) |
| ***F01D 25/00*** | (2006.01) |
| ***F03B 3/12*** | (2006.01) |

(52) U.S. Cl. ..... 416/169 A; 416/179; 416/192; 416/193 R; 416/223 R

(58) Field of Classification Search ..... 416/169 A, 416/179, 192, 193 R, 223 R
See application file for complete search history.

(56) References Cited

U.S. PATENT DOCUMENTS 5,328,330 A 7/1994 Monroe
(Continued)

FOREIGN PATENT DOCUMENTS

EP 0690236 A1 1/1996
(Continued)

OTHER PUBLICATIONS

English language abstract for FR2781843 extracted from espacenet.com database, dated Feb. 10, 2009.

(Continued)

*Primary Examiner* — Phat X Cao
(74) *Attorney, Agent, or Firm* — Howard & Howard Attorneys PLLC

(57) ABSTRACT

The fan impeller (10) comprises a hub (14) and blades (12) extending radially outward from the hub, the blades having a flattened airfoil profile cross section with a leading edge (24) and a trailing edge (26) between which a chord is defined. The blade (12) has a relative thickness that reached its maximum value ($E_{max}$) in the first quarter of the length of the chord measured from the leading edge (24), the relative thickness being defined by the ratio between the thickness of the blade and the length of the chord. The invention finds an application particularly in motor vehicle engine cooling fan impellers.

11 Claims, 3 Drawing Sheets

U.S. PATENT DOCUMENTS

| | | | | |
|---|---|---|---|---|
| 5,769,607 | A * | 6/1998 | Neely et al. | 416/189 |
| 5,996,685 | A * | 12/1999 | Alizadeh | 165/121 |
| 6,350,104 | B1 | 2/2002 | Moreau et al. | |
| 2005/0232778 | A1 | 10/2005 | Kakishita et al. | |

FOREIGN PATENT DOCUMENTS

| | | | |
|---|---|---|---|
| FR | 2781843 | A1 | 2/2000 |
| GB | 2362927 | A | 12/2001 |
| NL | 1019437 | C2 | 5/2003 |
| WO | WO 02059484 | A1 | 8/2002 |

OTHER PUBLICATIONS

English language abstract for NL1019437 extracted from espacenet.com database, dated Feb. 10, 2009.

PCT International Search Report for PCT/EP2007/052401, dated Jul. 3, 2007, 3 pages.

* cited by examiner

Fig.1
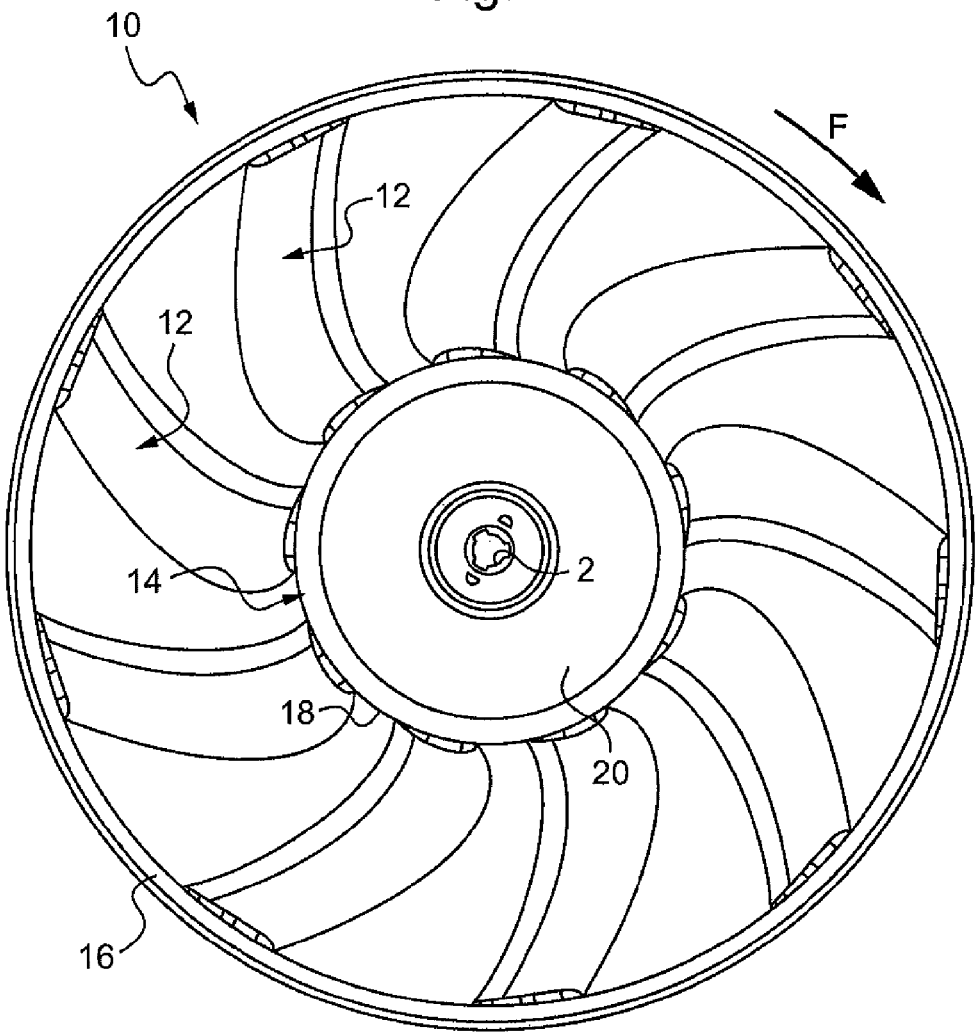
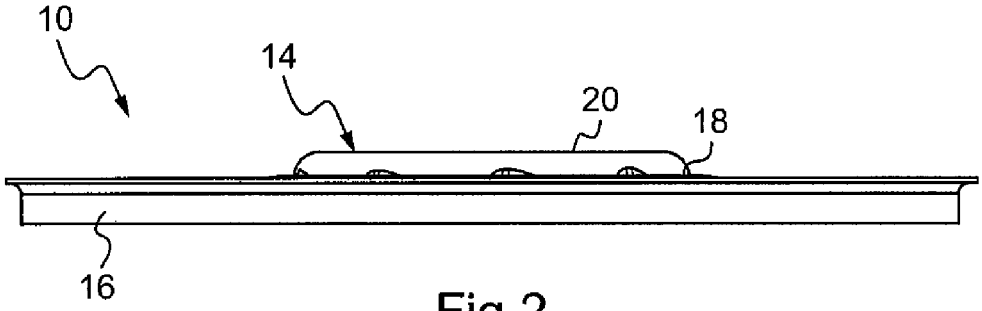
Fig.2

FAN PROPELLER, IN PARTICULAR FOR MOTOR VEHICLES

RELATED APPLICATIONS

This application claims priority to and all the advantages of International Patent Application No. PCT/EP2007/052401, filed on Mar. 14, 2007, which claims priority to French Patent Application No. FR 06/02510, filed on Mar. 23, 2006.

BACKGROUND

The invention relates to a fan impeller comprising a hub and blades extending radially outward from the hub, the blades having a flattened airfoil profile cross section with a leading edge and a trailing edge between which a chord is defined.

Impellers such as this are used in particular for cooling the engine that propels motor vehicles, the impeller producing an air flow through a heat exchanger, namely the radiator used to cool the propulsion engine.

The hub of the impeller, also known as the "bowl", can be fitted securely onto the shaft of a motor which may be an electric motor operated by control electronics.

The expression "flattened cross section" is intended here to denote the flat closed curve obtained by cutting through the blade on a surface that is a cylinder of revolution about the axis of the impeller and laying this cylindrical surface out flat. The chord is then defined as the length of straight line connecting the leading edge and the trailing edge.

When an impeller such as this is used for cooling a motor vehicle engine, it is positioned either in front of or behind the radiator used to cool the engine.

Designing impellers such as this in practice presents numerous problems when seeking to improve their aeraulic and acoustic performance.

Fan impellers are generally produced by molding a plastic. In order to reduce manufacturing costs, it is commonplace for the impeller blades to be produced in the form of an airfoil with the smallest possible thickness.

Furthermore, most known fan impellers have a fairly substantial axial depth in order to reduce the loads applied to the blades and therefore the noise generated by the fan.

Thin-blade impellers are compatible with reducing the axial size but on the other hand are better suited to cooling motor vehicle engines where the impeller lies a significant distance (typically several centimeters) away from the cooling radiator matrix.

Given the fact that the space available in the engine compartment of motor vehicles is often very limited, it is desirable not only to have impellers that occupy a small amount of space in the axial direction, but also to be able to reduce the distance between the impeller and the cooling radiator matrix.

Now, thin-blade impellers, as taught for example by FR-A-2 781 843 experience a drop in aeraulic and acoustic performance when situated close to a heat exchanger matrix, for example a cooling radiator. This drop in performance is due chiefly to the disturbances caused by the great deal of turbulence resulting from the heat exchangers. The expression "close" is intended here to denote a distance typically of the order of 1 cm.

SUMMARY

The invention provides a solution to these problems.

To this end, it proposes a fan impeller of the type defined hereinabove, in which the blade has a relative thickness that reaches its maximum value in the first quarter of the length of the chord measured from the leading edge, the relative thickness being defined by the ratio between the thickness of the blade and the length of the chord.

The blade has its maximum thickness in the first quarter of the chord measured from the leading edge. Furthermore, it is advantageous for this maximum relative thickness to be at least 12%.

This then yields a fan impeller the blades of which are far thicker in the region immediately behind the leading edge (in the first quarter of the chord length).

It has been found that a blade profile such as this makes it possible to improve the aeraulic and acoustic performance particularly when the impeller is situated in close proximity to a heat exchanger matrix, thus optimizing fan performance while at the same time limiting the axial size of the fan and impeller assembly. In other words, the impeller blade of the invention has a heavier, bulbous profile in the region immediately following the leading edge.

According to another feature of the invention, the leading edge has the greatest possible radius of curvature. This plays a part in giving the blade a bulbous profile in the region following the leading edge.

According to yet another feature of the invention, the airfoil profile has a centerline (neutral axis) with no point of inflection.

Further, it is advantageous for the airfoil profile to comprise a pressure face with an inversion of curvature. This feature makes it possible in particular to limit the disturbances and noise generated by the trailing edge.

In a preferred embodiment, the radially outer ends of the blades are connected by a shroud.

However, producing an impeller in which the aforementioned ends are free ends also falls within the scope of the invention.

BRIEF DESCRIPTION OF THE DRAWINGS

In the description which follows, which is given solely by way of example, reference is made to the attached drawings, in which:

FIG. 1 is a front view of a fan impeller according to the invention;

FIG. 2 is a side view of the impeller of FIG. 1;

DETAILED DESCRIPTION

Figure 3:
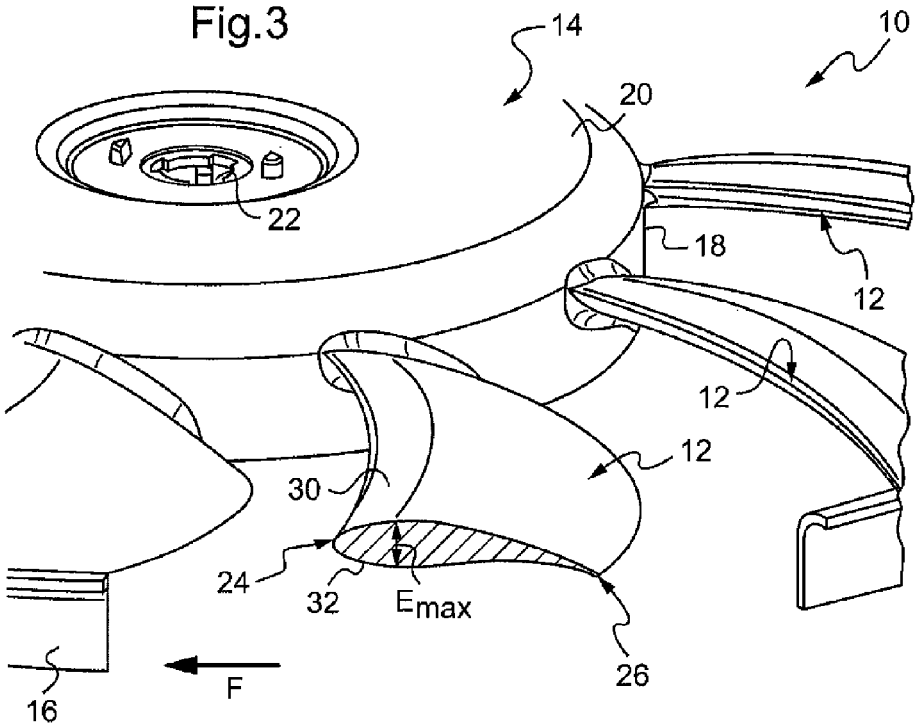
FIG. 3 is a perspective view, in part section, of the impeller of FIGS. 1 and 2, showing the undeveloped profile of a blade obtained by cutting through the blade on a surface that is a cylinder of revolution about the axis of the impeller.

The impeller 10 as depicted in FIGS. 1 to 3 comprises a multitude of blades 12, nine of them in this instance, which extend generally radially from a central hub 14, also known as a "bowl" and connected, at the periphery of the impeller, by a shroud 16. The hub, the blades and the shroud are formed as a single piece by molding, particularly in a plastic.

The hub 14 has a wall 18 that is a cylinder of revolution and to which the roots of the blades 12 are connected, and a flat frontal wall 20 facing in the upstream direction with respect to the direction of the air flow produced by the rotation of the impeller. The direction in which the impeller rotates is denoted by the arrow F in FIGS. 1 and 3.

Formed in the frontal wall 20 is a hole 22 so that the impeller can be fixed securely to a drive shaft (not depicted) connected to an electric motor (not depicted).

The blades 12 are generally identical and have a shape generally curved from the wall 18 of the hub 14 as far as the shroud 16.

Figure 4:
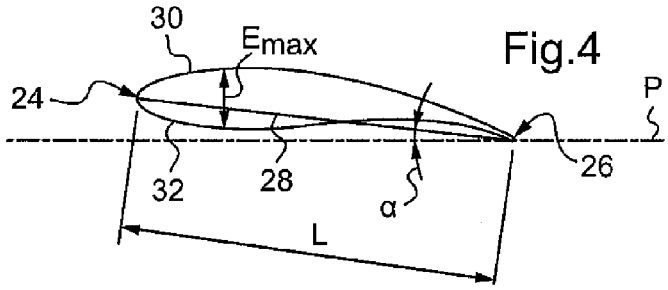
FIG. 4 depicts, to a larger scale, the flattened profile of the blade as obtained from the undeveloped profile of FIG. 3.

Reference is now made more specifically to FIGS. 3 and 4 to describe the configuration of a blade 12 of the impeller the undeveloped circular cross section of which has been depicted in FIG. 3 and the flattened cross section of which has been depicted in FIG. 4. The expression "flattened cross section" is used here to denote the flat closed curve obtained by cutting through the blade on a surface that is a cylinder of revolution about the axis of the impeller (see FIG. 3) and laying this cylindrical surface out flat (see FIG. 4).

As may be seen in FIGS. 3 and 4, the cross section of the blade has an overall airfoil profile with a leading edge 24 and a trailing edge 26. The expression "airfoil profile" is used here to denote an aerodynamic profile with a rounded leading edge and a rounded trailing edge the outline of which has no projecting corners and/or which has a thickness that varies continuously.

Studying the flattened profile of FIG. 4 it may be seen that the chord 28, that is to say the length of straight line running between the leading edge 24 and the trailing edge 28, is inclined by an acute angle ● with respect to a radial plane P, that is to say with respect to a plane perpendicular to the axis of the impeller. This acute angle ● generally varies along the length of the blade, from the blade root which is fixed to the hub, to the blade tip which is fixed to the shroud.

The length of the chord 28, measured between the leading edge 24 and the trailing edge 26, has a magnitude L which is marked in FIG. 4.

Figure 5:
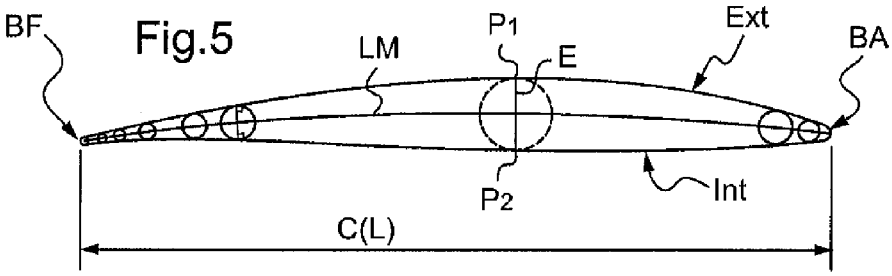
FIG. 5 is a diagram explaining a blade profile in general terms.

To make the description that follows easier to understand, reference is now made to FIG. 5 which illustrates, in general terms, a blade profile not in accordance with the invention. FIG. 5 shows the flattened cross section of the blade, according to the above definition, which has an airfoil profile. The chord C of the profile runs between the leading edge BA and the trailing edge BF and is of a length L. The airfoil has an upper surface Ext (the suction face) and a lower surface Int (the pressure face). The profile comprises a center line LM, also known as the "neutral axis", which runs substantially mid-way between the pressure face and the suction face.

The thickness E of the blade is defined with respect to a circle the center of which lies on the centerline (neutral axis) and which comes into contact with the pressure face and the suction face. The points P1 and P2 of tangency of the circle with the suction face and the pressure face respectively delimit a length of straight line that defines the thickness E at the points in question. FIG. 5 depicts a number of circles of this type at various points along the center line. It can be seen that the diameter of the circle, which corresponds to the thickness E, varies according to the position of the center along the centerline.

From this, it is also possible to define a relative thickness $E_{rel}$ as being the ratio between the thickness E of the profile and the length L of the chord.

Now that memories have been refreshed, reference is made once again to FIG. 4. It may be seen that the profile of the airfoil type has a thickness that is generally greater than the analogous profiles of the prior art (refer, in particular, to FR-A-2 781 843). In the invention, the blade has a relative thickness $E_{rel}$ that reaches its maximum value $E_{max}$ in the first quarter of the length of the chord measured from the leading edge 24. This maximum relative thickness $E_{max}$ is at least 12%. According to the invention, it may have a value of as high as 20%, and will usually be of the order of 15%. What this means is that the profile, on the leading edge side, has a characteristic bulbous shape, that is to say a heavier shape than do blades of the prior art. To encourage this bulbous shape, the leading edge 24 has the greatest possible radius of curvature.

Furthermore, the trailing edge 26 has the smallest possible thickness. What that is means is that, after the region in which the thickness is at its maximum, the suction face 30 and the pressure face 32 converge progressively towards one another. In the example, the pressure face 32 has an inversion of curvature, allowing the blade thickness to be reduced as the trailing edge 26 is approached.

It may be noted from FIGS. 3 and 4 that, measuring from the leading edge, the thickness increases continuously up to $E_{max}$ then decreases continuously as far as the trailing edge.

The fact that the greatest thickness lies in the first quarter of the length of the chord, measured from the leading edge 24, means that the noise generated by air turbulence when the impeller is positioned in close proximity to a heat exchanger can be reduced, that is to say when the impeller lies at a distance typically of the order of 1 cm away from the radiator in the case of a standard motor vehicle engine cooling radiator.

In addition, the fact of reducing the thickness of the profile at the trailing edge 26 also makes it possible to limit the disturbance and noise generated by the trailing edge of the profile.

The center line LM or neutral axis has no point of inflection. It is preferably given by a polynomial formula as disclosed in the already cited publication FR-A-2 781 843.

Figure 6:
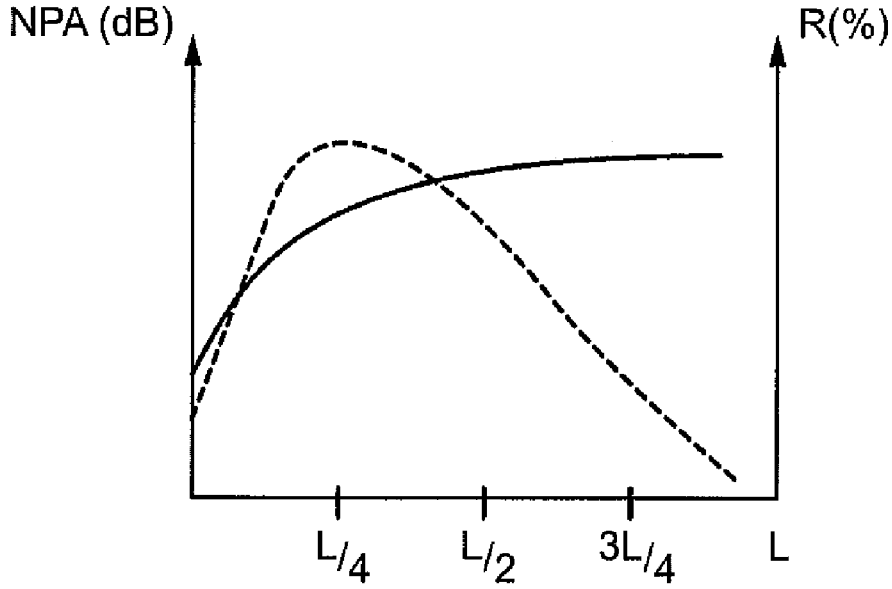
FIG. 6 is a graph showing curves of sound pressure level and efficiency (effectiveness) of an impeller according to the invention as a function of the location of the maximum thickness of the profile with respect to the chord length.

Reference is now made to FIG. 6 which shows the variations in sound pressure level NPA (expressed in decibels) and variation in efficiency or effectiveness R (expressed as a percentage) as a function of the position of the maximum relative thickness $E_{max}$ with respect to the length of the chord. The abscissa axis marks the points corresponding respectively to one quarter, one half, three quarters and the entire chord length L. It may be seen that the curve corresponding to the efficiency or effectiveness (depicted in broken line) has a crown in the region corresponding more or less to L/4. The curve corresponding to sound pressure level (depicted in continuous line) is an increasing curve which tends towards an asymptotic value from L/2 onward. At the L/4 point, the efficiency has already reached a significant level.

It will therefore be understood that, by siting the maximum thickness value in the first quarter of the chord length, substantially in the region corresponding to L/4, maximum efficiency can be achieved simultaneously with a particularly acceptable noise level.

Figure 7:
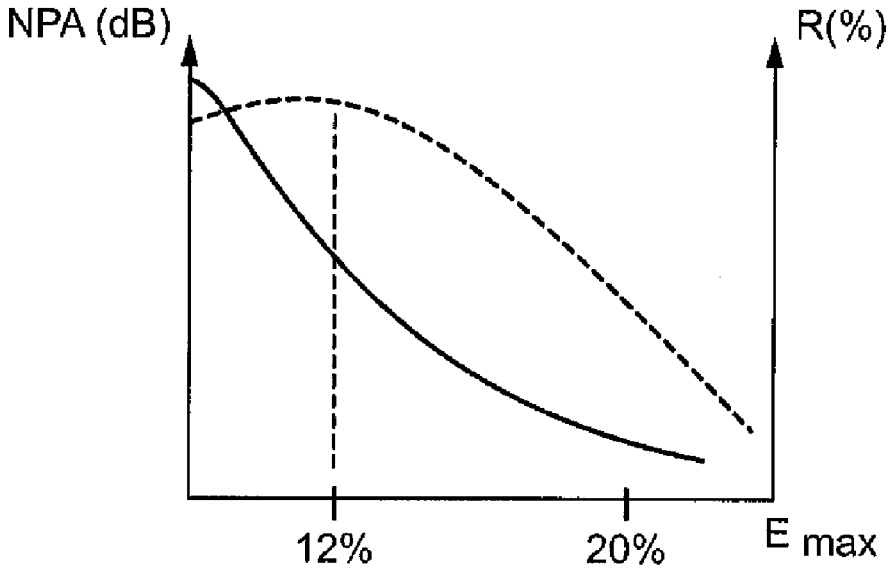
FIG. 7 is a graph showing curves of sound pressure level and efficiency (effectiveness) of an impeller according to the invention, for a given maximum relative thickness.

FIG. 7 is a similar depiction, except that the abscissa-axis is used for maximum thickness. It may be seen that the efficiency or effectiveness (curve drawn in broken line) has a crown in the position corresponding more or less to 12%. Furthermore, the sound pressure level decreases and reaches acceptable values between 12% and 20%. That shows that for $E_{max}$ values ranging between 12% and 20%, the sound pressure level is particularly low. By contrast, the efficiency is at its greatest at around the 12% mark. It then tends to decrease as the 20% value is neared.

Comparing the aforementioned two figures shows the benefit of having a relative thickness that reaches its maximum value in the first quarter of the chord length measured from the leading edge.

The invention finds a particular application in the motor vehicle engine cooling fan impellers.

The invention claimed is:

1. A fan impeller for cooling the engine that propels a motor vehicle and comprising a hub (14) and blades (12) extending radially outward from the hub, the blades having a flattened airfoil profile cross section with a leading edge (24) and a trailing edge (26) between which a chord (28) is defined, characterized in that the blade (12) has a relative thickness ($E_{rel}$) that reaches its maximum value ($E_{max}$) in the first quarter of the length (L) of the cord (28) measured from the leading edge (24), the relative thickness being defined by the ratio between the thickness (E) of the blade (12) and the length (L) of the chord (28), and wherein the maximum value ($E_{max}$) is between 12% and 20%.

2. A fan impeller according to claim 1, characterized in that the maximum value ($E_{max}$) is of the order of 15%.

3. A fan impeller according to claim 1, characterized in that the leading edge (24) has the greatest possible radius of curvature.

4. A fan impeller according to claim 1, characterized in that the airfoil profile has a centerline (LM) with no point of inflection.

5. A fan impeller according to claim 1, characterized in that the airfoil profile comprises a pressure face (32) with an inversion of curvature.

6. A fan impeller according to claim 1, characterized in that the radially outer ends of the blades (12) are connected by a shroud (16).

7. A fan impeller according to claim 3, characterized in that the airfoil profile has a centerline (LM) with no point of inflection.

8. A fan impeller according to claim 3, characterized in that the airfoil profile comprises a pressure face (32) with an inversion of curvature.

9. A fan impeller according to claim 3, characterized in that the radially outer ends of the blades (12) are connected by a shroud (16).

10. A fan impeller according to claim 4, characterized in that the radially outer ends of the blades (12) are connected by a shroud (16).

11. A fan impeller according to claim 5, characterized in that the radially outer ends of the blades (12) are connected by a shroud (16).

* * * * *